US009484676B2

(12) United States Patent
Chuang

(10) Patent No.: US 9,484,676 B2
(45) Date of Patent: Nov. 1, 2016

(54) ELECTRICAL CONNECTOR HAVING LATCHES AND METHOD OF MAKING THE SAME

(71) Applicant: FOXCONN INTERCONNECT TECHNOLOGY LIMITED, Grand Cayman (KY)

(72) Inventor: Shun-Jung Chuang, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/825,122

(22) Filed: Aug. 12, 2015

(65) Prior Publication Data

US 2016/0049751 A1 Feb. 18, 2016

(30) Foreign Application Priority Data

Aug. 13, 2014 (TW) ..... 103127706 A

(51) Int. Cl.

| | |
|---|---|
| ***H01R 27/00*** | (2006.01) |
| ***H01R 13/6581*** | (2011.01) |
| ***H01R 13/11*** | (2006.01) |
| ***H01R 13/405*** | (2006.01) |
| ***H01R 13/627*** | (2006.01) |
| ***H01R 43/24*** | (2006.01) |

(52) U.S. Cl.

CPC ..... *H01R 13/6581* (2013.01); *H01R 13/11* (2013.01); *H01R 13/405* (2013.01); *H01R 13/627* (2013.01); *H01R 43/24* (2013.01)

(58) Field of Classification Search

CPC H01R 13/6581; H01R 43/24; H01R 13/627; H01R 13/405; H01R 13/11; H01R 13/6585; H01R 24/60; H01R 13/66; H01R 13/514

USPC ..... 439/217

See application file for complete search history.

(56) References Cited

U.S. PATENT DOCUMENTS

| | | | | |
|---|---|---|---|---|
| 6,409,543 | B1 | 6/2002 | Astbury et al. | |
| 7,097,506 | B2 | 8/2006 | Nakada | |
| 7,645,143 | B2 * | 1/2010 | Rohrbach | H01R 13/6205 439/218 |
| 7,682,199 | B2 | 3/2010 | Ahn et al. | |
| 8,109,795 | B2 | 2/2012 | Lin et al. | |
| 8,262,411 | B2 | 9/2012 | Kondo | |
| 8,461,465 | B2 | 6/2013 | Golko et al. | |
| 8,684,769 | B2 | 4/2014 | Kao et al. | |
| 8,784,134 | B2 | 7/2014 | Wu et al. | |
| 8,794,981 | B1 | 8/2014 | Rodriguez et al. | |
| 2007/0049118 | A1 * | 3/2007 | Reeser | H01R 13/514 439/607.05 |
| 2012/0015561 | A1 * | 1/2012 | Tsai | H01R 24/60 439/660 |
| 2013/0117470 | A1 | 5/2013 | Terlizzi et al. | |
| 2013/0330976 | A1 | 12/2013 | Simmel et al. | |
| 2014/0194005 | A1 | 7/2014 | Little et al. | |

FOREIGN PATENT DOCUMENTS

| | | |
|---|---|---|
| CN | 203193000 | 9/2013 |
| TW | 484822 | 8/2014 |

* cited by examiner

*Primary Examiner* — Jean F Duverne
(74) *Attorney, Agent, or Firm* — Wei Te Chung; Ming Chieh Chang

(57) ABSTRACT

An electrical connector (100) includes a metal plate (1) having a pair of affixed portions (12) at opposite sides thereof, a first housing (21) insert molded with the metal plate and defining two rows of passageways (211), two rows of terminals (3) accommodated in the two rows of passageways, a pair of latches (4) respectively connected to the affixed portions of the metal plate and soldered on the circuit board, and a second housing (22) over molded with the first housing and the pair of latches to form a subassembly.

14 Claims, 8 Drawing Sheets

ELECTRICAL CONNECTOR HAVING LATCHES AND METHOD OF MAKING THE SAME

BACKGROUND OF THE INVENTION

1. Field of the Invention

The present invention relates to an electrical connector, and more particularly to a USB (Universal Serial Bus) connector adapted for being normally and reversely mated with a mating connector and a method of making the same. The instant application relates to the copending application Ser. No. 14/833,153 having the same applicant and the same assignee.

2. Description of Related Art

U.S. Pat. No. 8,684,769, issued on Apr. 1, 2014 discloses a socket connector and a mating plug connector. The socket connector includes an upper housing, a set of upper contacts arranged upon the upper housing, a lower housing, a set of lower contacts arranged upon the lower housing, and a shielding plate between the upper housing and the lower housing. The upper housing and the lower housing are then inserted into a bracket. The plug connector includes a housing having a pair of extending portions for fixing two rows of plug contacts and a shielding sheet between the two rows of plug contacts.

The grounding effect in the plug connector need be further improved.

A USB connector having better grounding effect is desired.

SUMMARY OF THE INVENTION

Accordingly, an object of the present invention is to provide an electrical connector having a better grounding effect.

In order to achieve the object set forth, an electrical connector includes a metal plate having a pair of affixed portions at opposite sides thereof, a first housing insert molded with the metal plate and defining two rows of passageways, two rows of terminals accommodated in the two rows of passageways, a pair of latches respectively connected to the affixed portions of the metal plate and soldered on the circuit board, and a second housing over molded with the first housing and the pair of latches to form a subassembly. Each terminal includes a securing portion secured to the first housing, a soldering portion extending rearwardly from the first housing for being soldered on a circuit board, and a contacting beam cantilevered forwardly from the first housing.

A method of manufacturing an electrical connector includes the steps of insert molding a first housing defining two rows of passageways and a metal plate, assembling two rows of terminals into the two rows of passageways and connecting a pair of latches to opposite sides of the metal plate, and over molding a second housing with the first housing, the terminals and the metal plate and covering the passageway.

The pair of latches are connected with the metal plate for latching with the mating receptacle. The pair of latches are soldered onto the circuit board for improving grounding effect.

Other objects, advantages and novel features of the invention will become more apparent from the following detailed description when taken in conjunction with the accompanying drawings.

DETAILED DESCRIPTION OF THE PREFERRED EMBODIMENT

Figure 1:
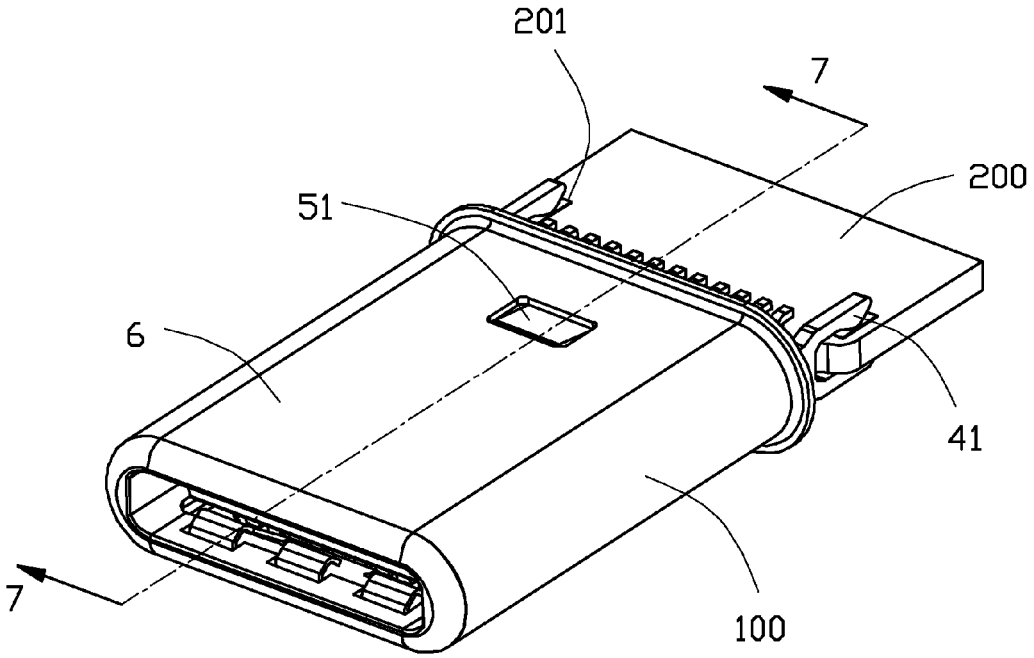
FIG. 1 is an assembled perspective view showing an electrical connector and a circuit board in accordance with the present invention.
Figure 2:
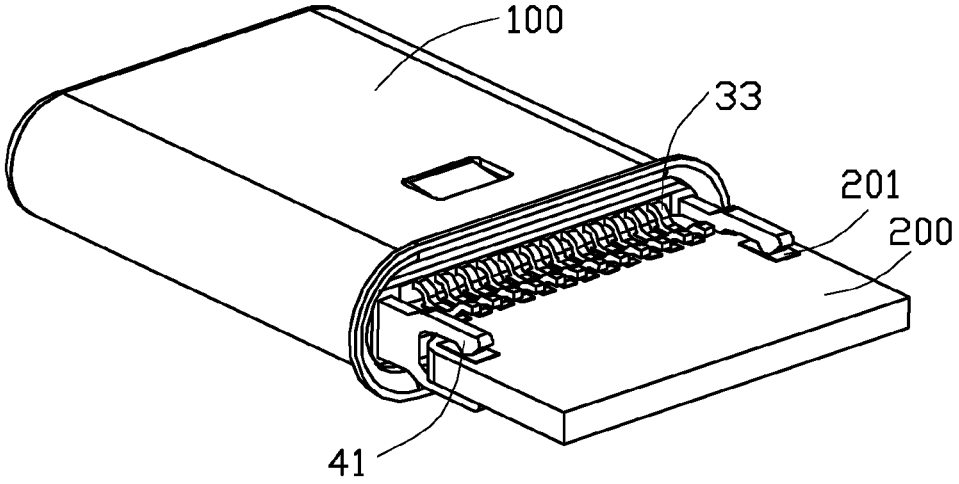
FIG. 2 is another assembled perspective view similar to FIG. 1, taken from another aspect.
Figure 3:
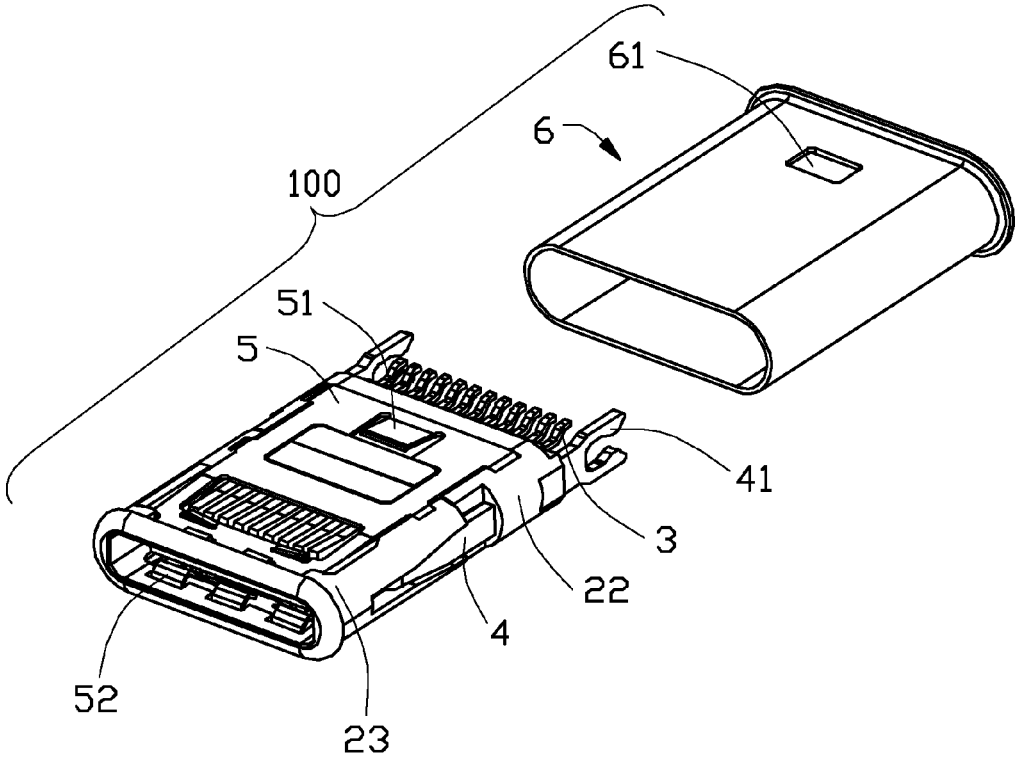
FIG. 3 is a partly assembled perspective view showing the electrical connector, with a shielding shell separated.
Figure 4:
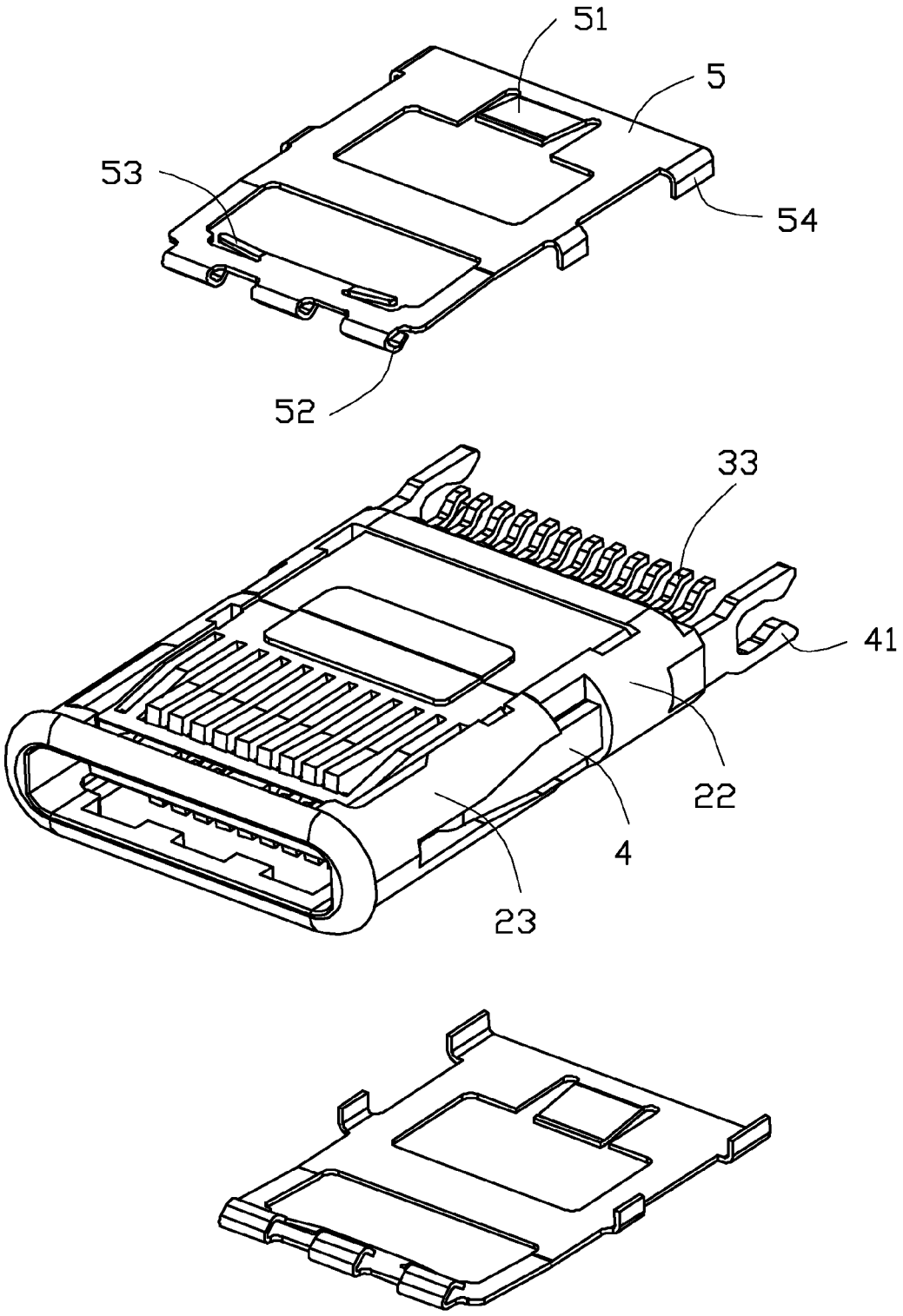
FIG. 4 is a partly exploded view showing the electrical connector, with the shielding shell removed and a pair of springs separated.

Reference will now be made in detail to the preferred embodiment of the present invention. Referring to FIGS. 1-7, an electrical connector 100 refers to a plug connector adapted for being normally and reversely inserted in a mating receptacle. The electrical connector 100 comprises a first or inner housing 21, a metal plate 1, two rows of terminals 3, a pair of latches 4, a second or intermediate housing 22, a third or main housing 23, a pair springs or spring plates 5, and a shielding shell 6.

The first housing 21 defines two rows of passageways 211 totally opened at upper and lower sides thereof.

Figure 6:
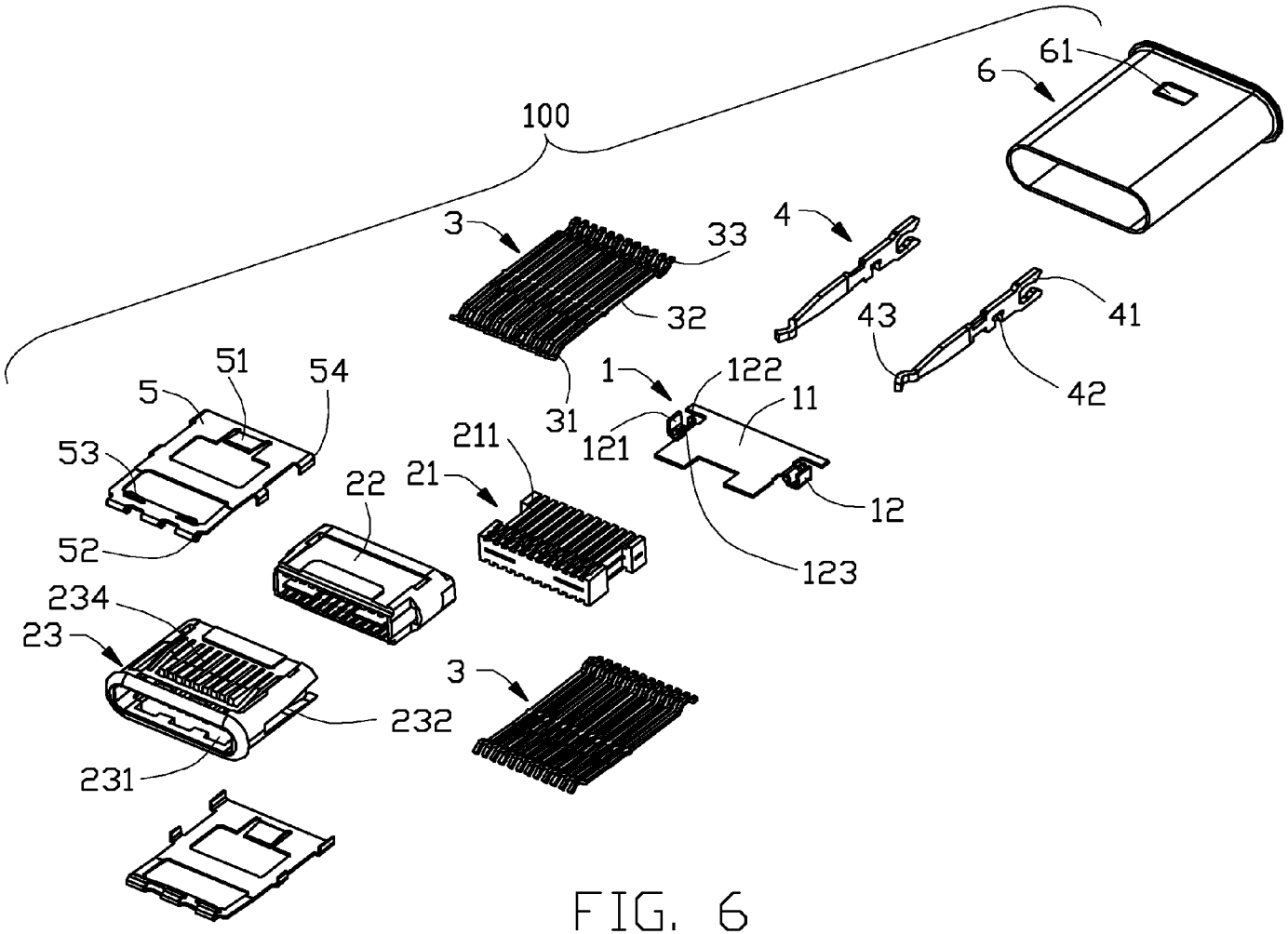
FIG. 6 is an exploded view of the electrical connector.

Referring to FIG. 6, the metal plate 1 includes a main portion 11, and a pair of affixed portions 12 formed at opposite sides of the main portion 11. The affixed portion 12 includes an outer portion 121, an inner portion 122, and a connecting portion 123 connecting the outer portion 121 and the inner portion 122.

Two rows of terminals 3 comprise an upper row of terminals 3*b* and a lower row of terminals 3*a*. Each terminal 3 comprises a body portion 32 received in the passageway 211, a contact beam 31 cantilevered forwardly from the first housing 32 and having a contacting portion (not labeled), and a soldering portion 33 extending rearwardly.

Each latch 4 includes a latching portion 43 at a front, an engaging portion 42 formed into a cutout at substantially a middle portion thereof, and a pair of soldering feet 41 projecting toward each other.

Figure 5:
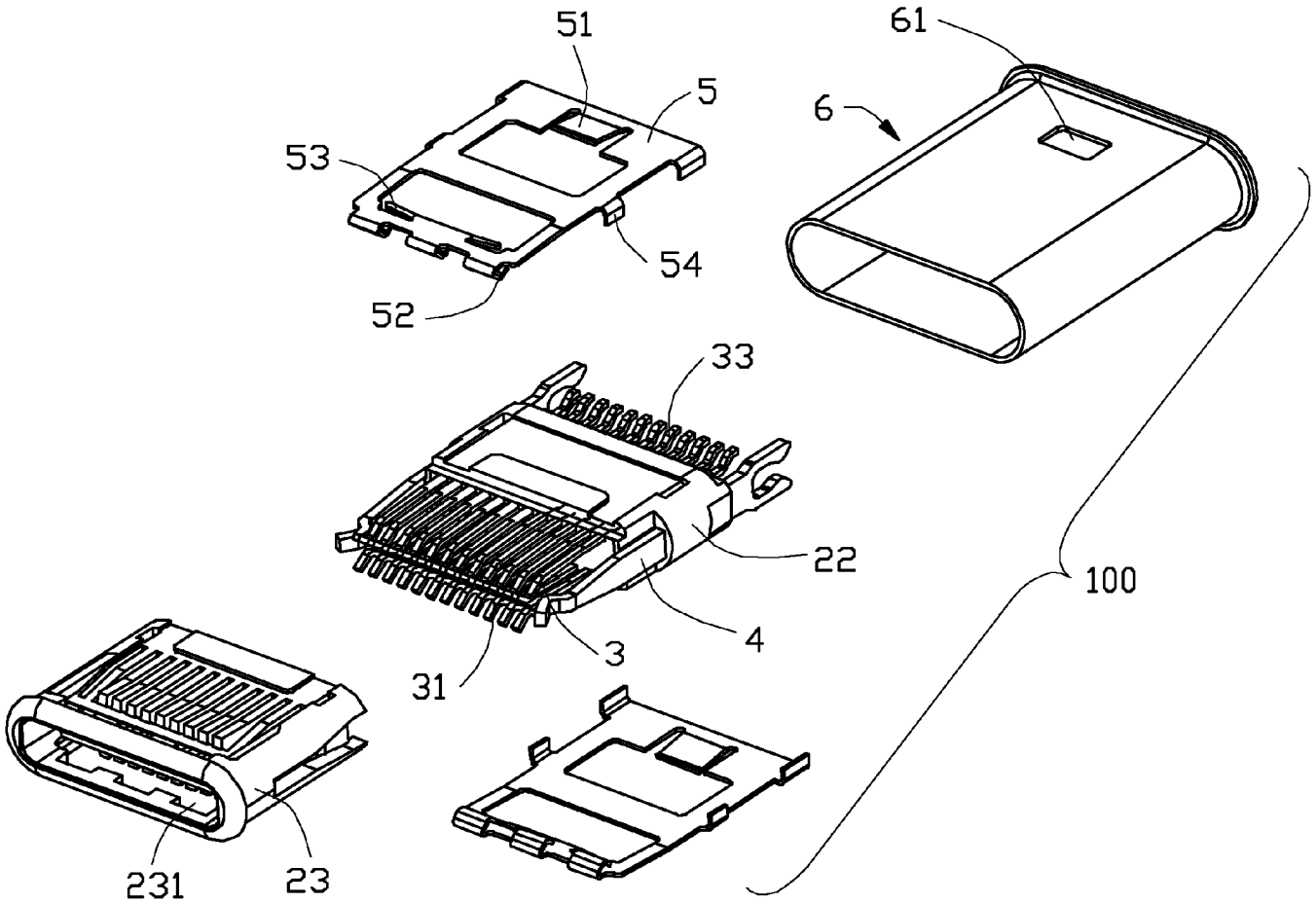
FIG. 5 is a partly exploded view of a subassembly, a pair of springs, a third housing, and a shielding shell shown in FIG. 4.

Referring to FIG. 5, the third housing 23 defines mating hole 231, a pair of recesses 232 at right and left sides thereof and a plurality of slits 234 at upper and lower sides thereof.

Each spring 5 has a plurality of mating portions 52 bent toward the mating hole 231 for electrically connecting with the mating receptacle. Each spring 5 has a grounding portion 53 tilting away from the mating hole 231 for contacting with the shielding shell 6. Each spring 5 is formed with a plurality of stabs 54 piercing into the second housing 22 and the third housing 23 and a tongue plate 51 tilting toward the shielding shell 6.

The shielding shell 6 is formed into a barrel and defining a pair of openings 61.

Figure 8:
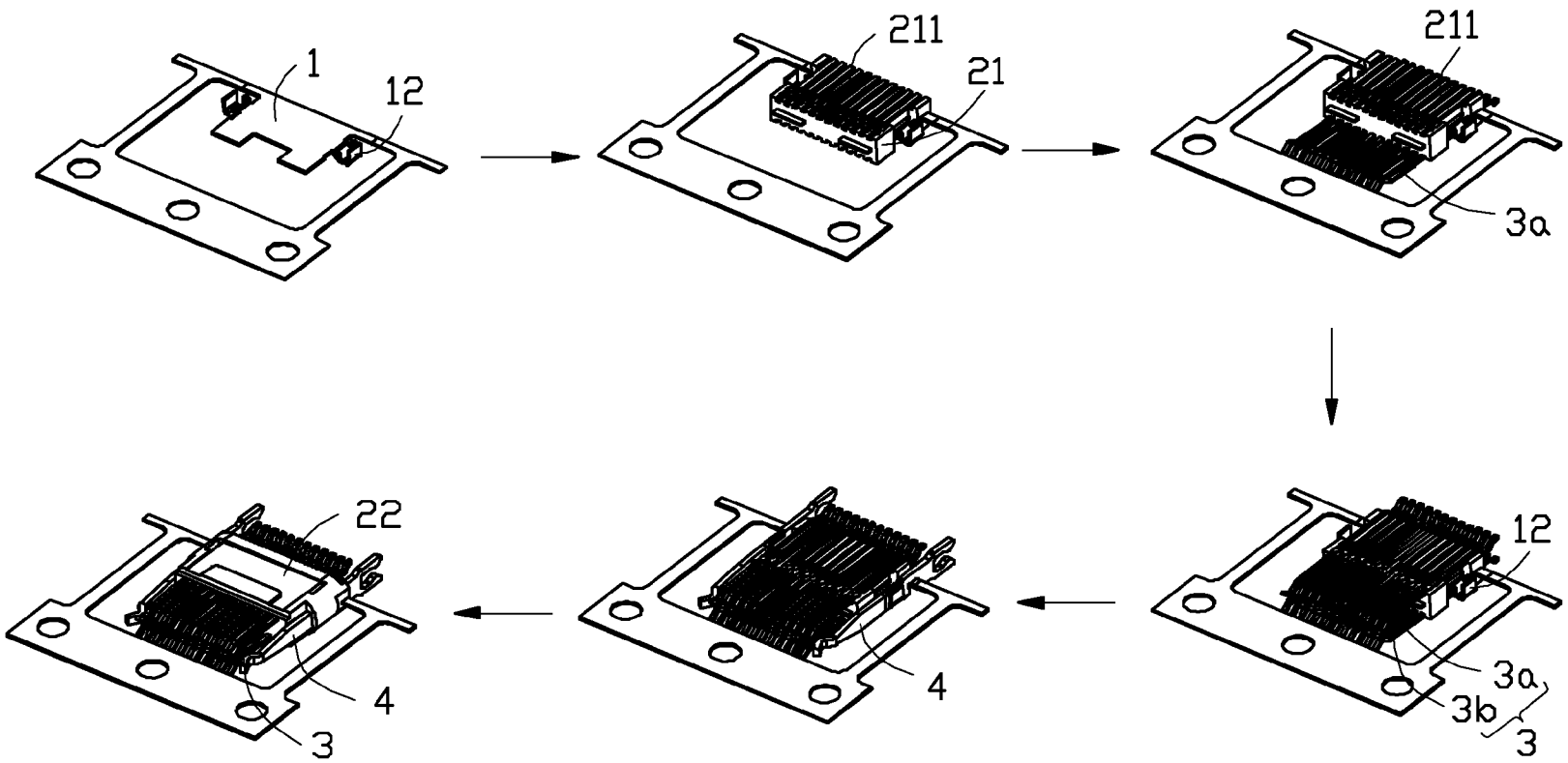
FIG. 8 is a view showing the steps of manufacturing the subassembly.

Referring to FIG. 8, a method of manufacturing an electrical connector 100 comprises the steps of insert molding the metal plate 1 and the first housing 21 defining two rows of passageways 211, assembling the lower rows of terminals 3*a* into the two rows of passageways 211 along a top-to-bottom direction, assembling the lower rows of terminals 3*b* into the two rows of passageways 211 along the top-to-bottom direction, mounting a pair of latches 4 to opposite sides of the metal plate 1, and over molding the second housing 22 with the first housing 21, the terminals 3 and the metal plate 1 and covering the passageways 211 to form a subassembly. The engaging portions 42 of the latches 4 latch with the connecting portions 123 of the metal plate 1 after the step of assembling the terminals 3.

Then, the third housing 23 is mounted on the subassembly, with the pair of latching portions 43 of the latches 4 projecting into the mating hole 231 through the recesses 232. The pair of springs 5 are mounted on the second housing 22 and the third housing 23, with the mating portions 52 extending to the mating hole 231 for electrically connecting with the mating receptacle and the stabs 54 piercing into the second housing 22 and the third housing 23. The subassembly and the pair of springs 5 are enclosed in the shielding shell 6. The grounding portions 53 contact with the shielding shell 6. Each tongue plate 51 latches with the opening 61 of the shielding shell 6.

Figure 7:
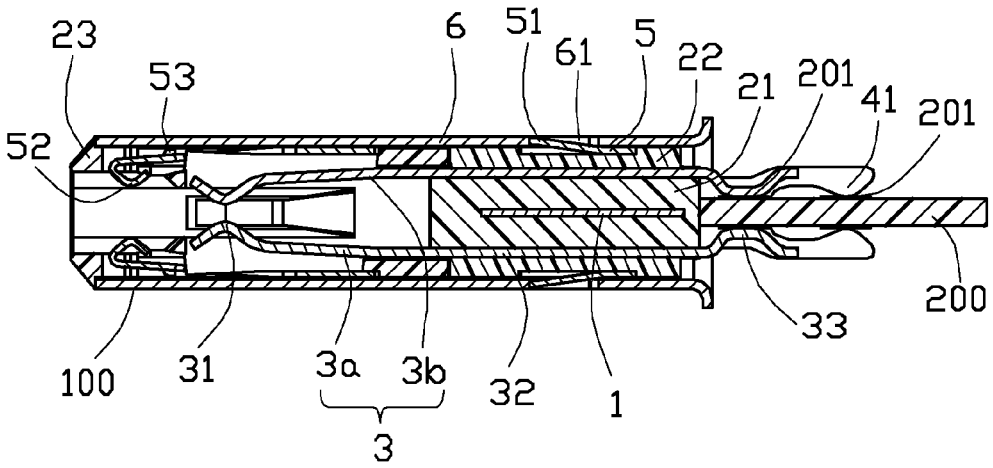
FIG. 7 is a cross-sectional view of the electrical connector and the circuit board along line 7-7 of FIG. 1.

Referring to FIGS. 1 and 7, the electrical connector 100 are soldered on a circuit board 200 defining a plurality of conductive pads 201. The pair of soldering feet 41 of each latch 4 are used for guiding and being soldered on the conductive pads 201 of opposite sides of the circuit board 200. The soldering portions 313 of two rows of terminals 3 are used for guiding and being soldered on the conductive pads 201 of the opposite sides of the circuit board 200.

The pair of latches 4 are connected with the metal plate 1 for latching with the mating receptacle. The pair of latches 4 are soldered onto the circuit board 200 for improving grounding effect. The mating portions 52 electrically connect with the mating receptacle and the grounding portions 53 contact with the shielding shell 6 for improving grounding effect.

It is to be understood, however, that even though numerous characteristics and advantages of the present invention have been set forth in the foregoing description, together with details of the structure and function of the invention, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a metal plate having a pair of affixed portions at two opposite sides thereof;

a first housing insert molded with the metal plate and defining two rows of passageways, said affixed portions of the metal plate extending outwardly from the first housing;

two rows of terminals accommodated in the two rows of passageways, each terminal including a securing portion secured to the first housing, a soldering portion extending rearwardly from the first housing for being soldered on an internal circuit board, and a contacting beam cantilevered forwardly from the first housing;

a pair of latches respectively mounted to the affixed portions of the metal plate for soldering on the circuit board; and a second housing over molded with the first housing and the pair of latches to form a subassembly; further comprising a third housing mounted on the subassembly and defining a mating hole and a pair of springs mounted on the second housing and the third housing, each spring having a plurality of mating portions bent toward the mating hole; further comprising a shielding shell enclosing the subassembly and the pair of springs, each spring having a grounding portion extending away from the mating hole for contacting with the shielding shell; wherein each spring is formed with a plurality of stabs piercing into the second housing and the third housing.

2. The electrical connector as claimed in claim 1, wherein said passageways are totally opened at upper and lower sides of the first housing, and the terminals are assembled into the passageways along a top-to-bottom direction.

3. The electrical connector as claimed in claim 1, wherein said contacting beams of the terminals extend forwardly beyond the second housing, and the metal plate has a front end extending forwardly from the second housing to suspend between the contacting beams of the two rows of terminals along a top-to-bottom direction.

4. The electrical connector as claimed in claim 1, wherein each latch is formed with an engaging portion, the engaging portion includes an inner portion, an outer portion, and a connecting portion, and the affixed portion has a cutout engaging with the connecting portion to latch the latch with the metal plate.

5. The electrical connector as claimed in claim 4, wherein said second housing is over molded at the affixed portions and the engaging portions.

6. The electrical connector as claimed in claim 1, wherein each latch has a pair of soldering feet projecting toward each other.

7. The electrical connector as claimed in claim 1, wherein each spring is formed with a plurality of stabs piercing into the second housing and the third housing.

8. An electrical connector comprising:

a metallic plate embedded within an insulative inner housing via an insert molding process;

opposite upper and lower passageways formed around opposite upper and lower faces of the inner housing in the vertical direction, each of said passageways extending along a front-to-back direction perpendicular to said vertical direction while either said upper passageways or said lower passageways being side by side arranged with one another along a transverse direction perpendicular to both said vertical direction and said front-to-back direction;

opposite resilient upper and lower terminals disposed in the corresponding upper and lower passageways, respectively;

an insulative intermediate housing applied upon opposite upper and lower faces of the inner housing to retain the upper and lower terminals in the corresponding upper and lower passageways, respectively, via another insert molding process; and an insulative main housing located in front of the intermediate housing and defining opposite upper and lower slits in opposite upper and lower surfaces; wherein said upper and lower slits are aligned with the corresponding upper and lower passageways in the front-to-back direction, respectively, to receive the corresponding upper and lower terminals therein when said upper and lower terminals are deflected outwardly in the vertical direction during mating; further including a pair of deflectable latches located by two opposite lateral sides of the metallic plate and retained by the intermediate housing; wherein the pair of latches are fixed to the metallic plate for temporary retention before the intermediate housing is applied thereupon.

9. The electrical connector as claimed in claim 8, wherein before the intermediate housing is applied upon the inner housing, said upper passageways are exposed upwardly in the upper face, and the lower passageways are exposed downwardly in the lower face.

10. The electrical connector as claimed in claim 8, further including a pair of spring plates located upon opposite top and bottom surface of the main housing and attached to either the main housing or the intermediate housing.

11. The electrical connector as claimed in claim 10, further including a metallic shielding sleeve surrounding the main housing and the intermediate housing, and means for retaining the shielding sleeve to the spring plates for preventing relative moment therebetween along the front-to-back direction.

12. The electrical connector as claimed in claim 10, wherein a length of each of said spring plates in the front-to-back direction is essentially equal to a sum of those of the main housing and the sub-housing in the front-to-back direction.

13. The electrical connector as claimed in claim 8, wherein the metallic plate defines a first thickness direction along said vertical direction while each of the latches defines a second thickness direction along the transverse section, and the latches are pre-assembled to the metallic plate before the intermediate housing is molded with the terminal modules.

14. The electrical connector as claimed in claim 8, wherein said main housing forms a pair of recesses in two opposite lateral sides in the transverse direction through which said pair of latches extend inwardly into a mating hole of the main housing.

* * * * *